US009464390B2

(12) United States Patent
Kreutz

(10) Patent No.: US 9,464,390 B2
(45) Date of Patent: Oct. 11, 2016

(54) ROAD CONSTRUCTION MACHINE

(71) Applicant: BOMAG GmbH, Boppard (DE)
(72) Inventor: Tobias Kreutz, Ellern (DE)
(73) Assignee: BOMAG GmbH, Boppard (DE)

( * ) Notice: Subject to any disclaimer, the term of this patent is extended or adjusted under 35 U.S.C. 154(b) by 39 days.

(21) Appl. No.: 14/420,741
(22) PCT Filed: Jul. 26, 2013

(86) PCT No.: PCT/EP2013/002225
§ 371 (c)(1),
(2) Date: Feb. 10, 2015

(87) PCT Pub. No.: WO2014/023398
PCT Pub. Date: Feb. 13, 2014

(65) Prior Publication Data
US 2015/0204031 A1 Jul. 23, 2015

(30) Foreign Application Priority Data
Aug. 10, 2012 (DE) ..... 10 2012 015 894

(51) Int. Cl.
*E01C 19/48* (2006.01)
*E01C 19/23* (2006.01)
*E01C 19/12* (2006.01)

(52) U.S. Cl.
CPC ..... *E01C 19/4806* (2013.01); *E01C 19/12* (2013.01); *E01C 19/238* (2013.01); *Y10T 29/49826* (2015.01)

(58) Field of Classification Search
CPC .. E01C 19/4806; E01C 19/12; E01C 19/238; E01C 19/174; E01C 19/176; E01C 19/17; E01C 19/172; E01C 19/26; E01C 19/236; E01C 21/00; E02F 3/962; A01C 23/00; A01C 23/008; A01G 25/00; A01G 25/09
See application file for complete search history.

(56) References Cited

U.S. PATENT DOCUMENTS 2,078,900 A * 4/1937 Biles ..... E01C 19/266 280/43.17
2,138,904 A * 12/1938 Carswell ..... E01C 21/00 172/146
2,192,027 A * 2/1940 Crowder ..... E01C 21/00 111/128
2,645,524 A * 7/1953 Kelly ..... B08B 9/0321 137/238

(Continued)

FOREIGN PATENT DOCUMENTS

FR 1 219 355 A 5/1960
FR 2 853 672 A1 10/2004

OTHER PUBLICATIONS

Espacenet, English Machine Abstract of FR 2 853 672 A1, published on Oct. 15, 2004, retrieved from http://worldwide.espacenet.com (1 page).

(Continued)

*Primary Examiner* — Abigail A Risic
(74) *Attorney, Agent, or Firm* — Wood, Herron & Evans, LLP

(57) ABSTRACT

A self-propelled road construction machine, especially a road roller, comprising a service water tank with two tank bodies which are connected in parallel via a balancing line. The balancing line and the tank bodies are connected via a plug connection, in which the balancing line consists of a flexurally rigid connection pipe and the tank bodies respectively comprise sealed insertion openings for the pipe.

11 Claims, 4 Drawing Sheets

(56) References Cited

U.S. PATENT DOCUMENTS

| | | | | | |
|---|---|---|---|---|---|
| 3,344,721 | A * | 10/1967 | Ferm | E01C 19/231 | 404/75 |
| 4,009,967 | A * | 3/1977 | Layton | E01C 19/238 | 239/223 |
| 4,593,855 | A * | 6/1986 | Forsyth | A62C 27/00 | 169/24 |
| 5,199,196 | A * | 4/1993 | Straley | E01C 21/00 | 111/118 |
| 5,476,146 | A * | 12/1995 | Brown | A62C 27/00 | 169/14 |
| 7,520,411 | B2 * | 4/2009 | Bieker | B60P 3/426 | 169/24 |
| 2016/0053444 | A1 * | 2/2016 | Bornemann | E01C 19/23 | 404/128 |

OTHER PUBLICATIONS

European Patent Office, International Search Report and Written Opinion of the International Searching Authority, International Application No. PCT/EP2013/002225, mailed Dec. 10, 2013 (8 pages).

European Patent Office, Engilsh Translation of the International Search Report, International Application No. PCT/EP2013/002225, mailed Dec. 10, 2013 (2 pages).

* cited by examiner

ROAD CONSTRUCTION MACHINE

CROSS-REFERENCE TO RELATED APPLICATIONS

This application is a submission under 35 U.S.C. §371 of International Application No. PCT/EP2013/002225, filed Jul. 26, 2013, which claims priority to German Application No. 10 2012 015 894.7, filed Aug. 10, 2012, the disclosures of which are hereby expressly incorporated by reference herein in their entireties.

FIELD OF THE INVENTION

The present invention relates to a self-propelled road construction machine, especially a road roller, comprising a service water tank with two tank bodies which are connected in parallel via a balancing line. The present invention further relates to a service water tank for a road roller and a production method for a construction machine.

BACKGROUND OF THE INVENTION

Self-propelled road rollers for producing traffic routes are generally known. In order to prevent impurities from adhering to a drum, the drum is sprayed with water which is stored in a service water tank. Since the required quantity of service water cannot be stored in a single tank container for constructional reasons, the service water tank is frequently divided into two tank bodies which are connected to each other via a flexible hose. The mounting of the hose with hose clips is time-consuming and susceptible to mounting errors.

SUMMARY OF THE INVENTION

The present invention is based on the object of providing a road-construction machine and a service water tank of the type mentioned above which can be mounted in a simple way.

This object is achieved with respect to the road construction machine in that the balancing line and the tank bodies are connected via a plug connection, in which the balancing line consists of a flexurally rigid connection pipe and the tank bodies respectively comprise sealed insertion openings for the pipe. The object is achieved with respect to the tank body in that the balancing line and the tank bodies are connected via a plug connection, in which the balancing line consists of a flexurally rigid connection pipe and the tank bodies respectively comprise sealed insertion openings for the pipe.

The present invention comes with the advantage that the mounting time for the machine is reduced and verifying the correct mounting is possible by simple visual inspection.

Mounting is simplified further in that the connection pipe is guided in a self-supporting manner between the insertion openings.

It is especially advantageous that the tank bodies are arranged on both sides with respect to the central plane of the machine, and preferably symmetrically to the central plane of the machine. This facilitates installation from both sides of the road-building machine and the available space is utilized optimally.

The tank bodies can principally have different sizes and different volumes. It is advantageous in terms of weight distribution however that the tank bodies substantially have the same size and the same volume.

A preferred further development of the present invention is that the connection pipe comprises at least one axially acting first stopper for limiting the insertion depth. This prevents inadvertent slippage of the connection pipe into a tank body on the one hand and ensures on the other hand that the connection pipe is inserted to a sufficiently deep extent into the tank body. Also, the correct positioning of the connection pipe can be checked on the basis of the position of the stopper.

It is especially advantageous to provide two stoppers, so that the connection pipe is unable to move or loosen between the two tank bodies after mounting.

Simple and secure fastening of the tank bodies is provided by clamping them to the support frame with a tie rod. Outside claddings can be attached easily to the free ends of the tie rods.

With respect to the method, the object of the present invention is achieved by the following method steps:

Insertion of the connection pipe up to the first stopper in the first tank body; fastening of the first tank body to the support frame; attaching the second tank body to the connecting pipe; and fastening of the second tank body to the support frame.

BRIEF DESCRIPTION OF THE DRAWINGS

The present invention will be explained below in greater detail by reference to an embodiment shown in the schematic drawings, wherein.

DETAILED DESCRIPTION OF THE INVENTION

Figure 1:
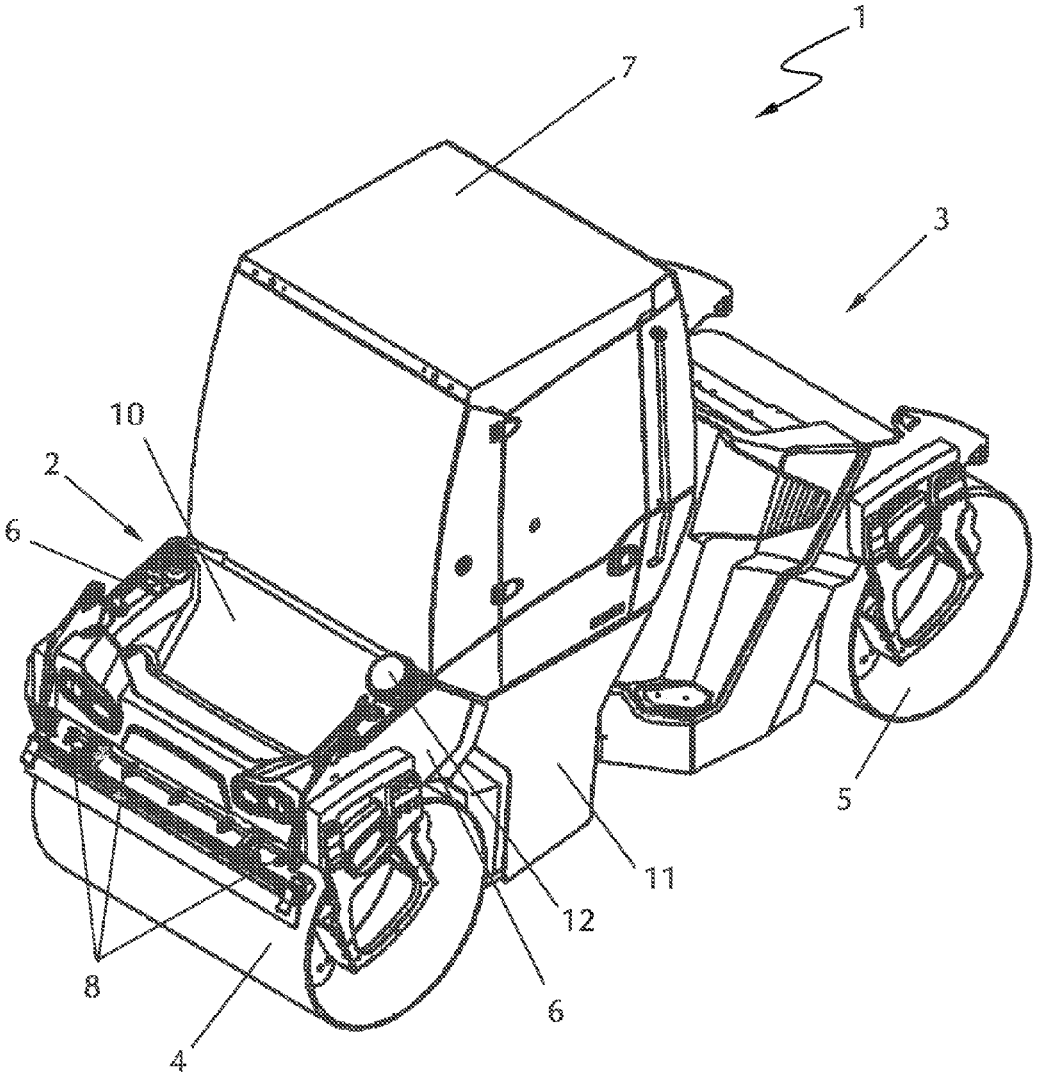
FIG. 1 shows a perspective view of a road roller.

FIG. 1 shows a self-propelled construction machine arranged as a road roller 1 with a front carriage 2 and a rear carriage 3, which are connected to each other via an articulated pendulum joint. A front drum 4 is arranged on the front carriage 2 and a rear drum 5 is arranged on the rear carriage 3. The front carriage 2 comprises a support frame, on which two side frames 6 for the front drum 4 are also arranged. A driver's cabinet 7 is further situated on the front carriage 2.

Spray nozzles 8 are arranged in front of the front drum 4 over the entire width of the drum 4, with which the surface of the drum is sprayed in operation in order to prevent impurities from adhering. The spray nozzles 8 are supplied from a service water tank 9 (FIG. 2), which is arranged behind lateral claddings 11 of the front carriage 2 beneath the driver's cabinet 7 and partly beneath a cladding 10 on the top side, the illustration showing only one of the two lateral claddings 11. The service water tank 9 is provided with a filler neck 12 which is guided to the outside above the cladding 10 on the top side.

Figure 2:
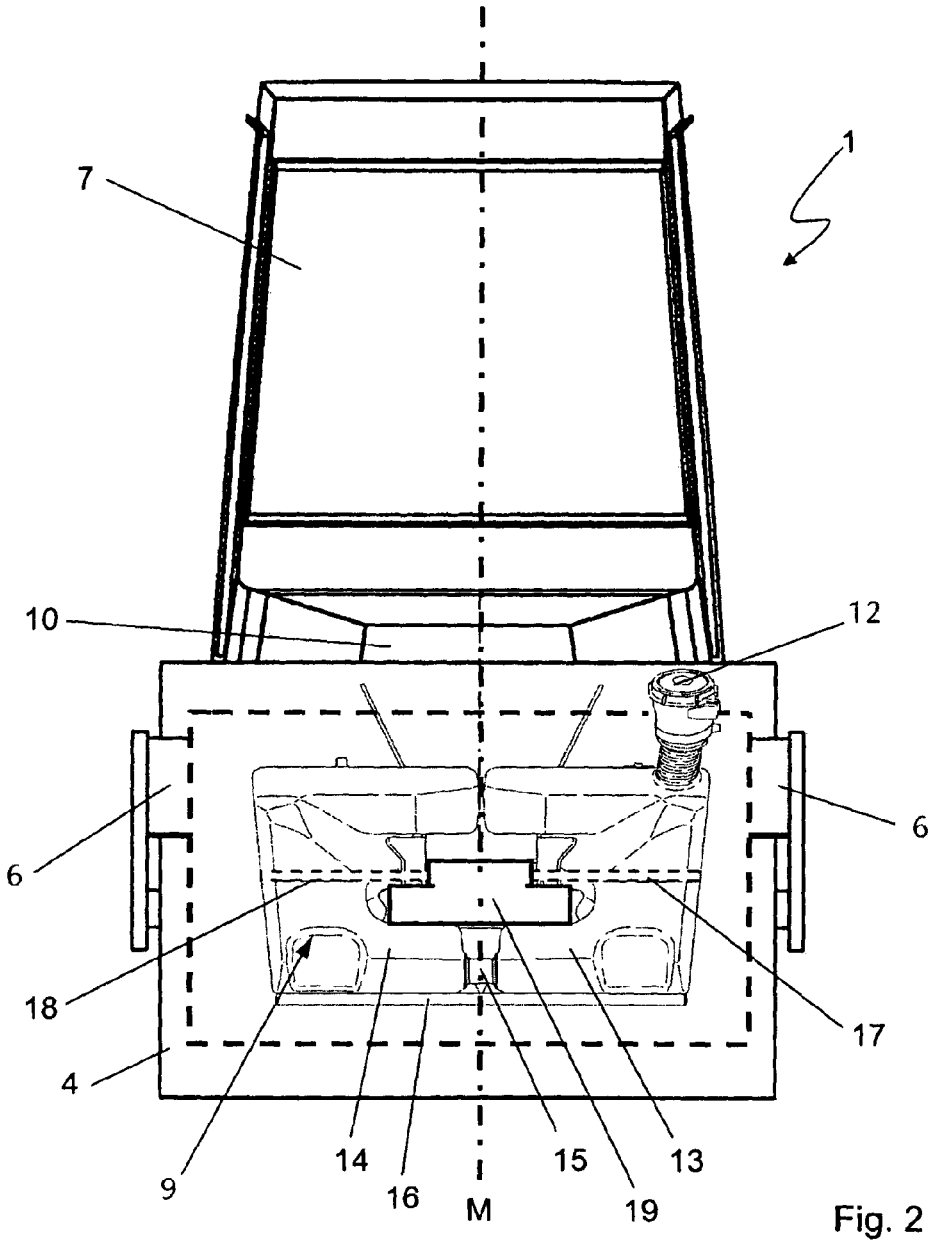
FIG. 2 shows a partially sectional front view of a road roller.

FIG. 2 shows a front view of the road roller 1 with a partial sectional view which is indicated by a broken line and provides a view of the service water tank 9. The service water tank is composed of two self-supporting tank bodies 13, 14 made of plastic and a flexurally rigid connection pipe 15. The connection pipe 15 connects the two tank bodies 13, 14 in their base regions. The two tank bodies 13, 14 are connected in parallel via the connection pipe 15, i.e., the connection pipe 15 is used as a balancing line in order to keep the content of the two tank bodies at the same level. They are therefore connected via the connection pipe 15 according to the principle of communicating vessels. The filler neck 12 is located on one of the tank bodies 13, 14.

The two tank bodies 13, 14 are arranged on both sides of the longitudinal central plane M of the road roller 1. In the illustrated example, they are arranged substantially symmetrically to the longitudinal central plane M. Their sizes and volumes are approximately equal and their shapes are designed in a substantially mirror-inverted manner with respect to each other. They are mounted on a base carrier 16 of a support frame of the road roller 1. Furthermore, they are respectively braced via a tie rod 17, 18, which extends transversely to the longitudinal central plane M, on a frame part 19 of the support frame arranged in the longitudinal center of the front carriage 2. FIG. 2 shows the tie rods 17, 18 in a purely schematic manner and not true to scale. The tie rods 17, 18 extend in tubular channels 27 (FIG. 4), which are arranged transversely through the tank bodies 13, 14.

Figure 3:
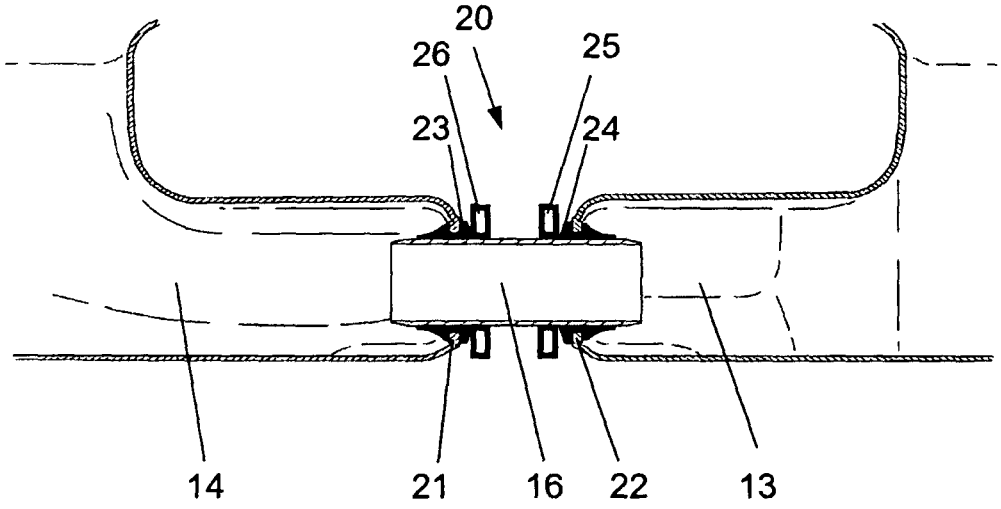
FIG. 3 shows a sectional view of a part of the service water tank of FIG. 2.

As is shown in FIG. 3 in detail, the connection pipe 15 and the tank bodies 13, 14 are connected via a plug connection 20. The plug connection 20 is formed on the one hand in that the two tank bodies 13, 14 respectively comprise an insertion opening 21, 22 of equal diameter, which openings are coaxially opposite each other. Each insertion opening 21, 22 is provided with an annular seal 23, 24. On the other hand, the plug connection 20 is formed by the connection pipe 15, the end regions of which have an outside diameter which is complementary to the insertion openings 21, 22 and are thus inserted into the insertion openings 21, 22. The connection pipe 15 is exclusively held by the insertion openings 21, 22 or the sealing rings 23, 24, i.e., it bridges the distance between the two tank bodies 13, 14 in a self-supporting manner.

Annular first and second stoppers 25, 26 acting in axial direction are respectively arranged in a non-displaceable manner on the connection tube 15 with predetermined distance from the two ends of the connection pipe 15. The stoppers 25, 26 prevent the connection tube 15 from being inserted too deeply into the insertion openings 21, 22. The stoppers 25, 26 thus serve as axial securing means for the connection pipe 15.

Figure 4:
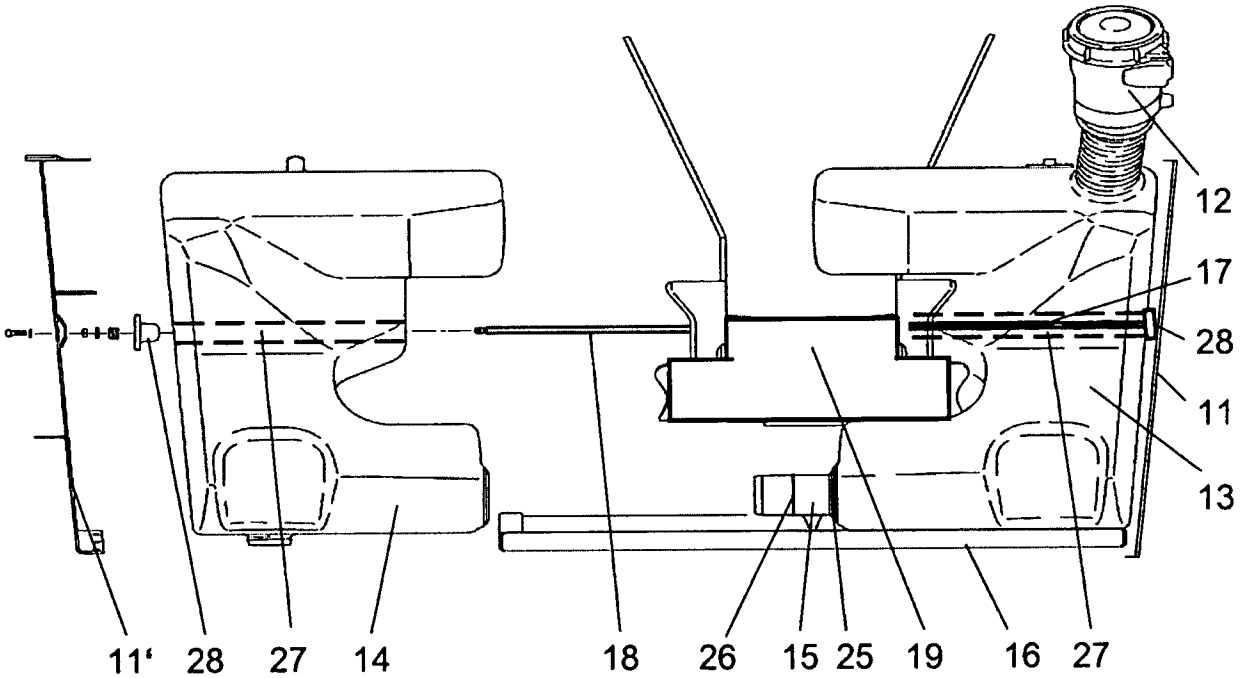
FIG. 4 shows an exploded view of the service water tank of FIG. 2.

The mounting of the service water tank 9 (FIG. 2) is described by reference to the exploded view of FIG. 4. A first tank body 13 is installed in the front carriage 2, in that it is placed on the base carrier 16 and is clamped by means of a first tie rod 17 on the frame part 19. The fastening by means of the first tie rod 17 corresponds to the fastening of the second tank body 14, which will be described below in closer detail. The connection pipe 15 is then inserted with one end up to the respective first stopper 25 into the insertion opening 22 of the first tank body 13. The second tie rod 18 is then fastened with one end to the frame part 19. The second tank body 14 is subsequently slid to its position on the base carrier 16. During the sliding movement, the second tie rod 18 is guided into the associated tubular channel 27 of the second tank body 14. Furthermore, the insertion opening 21 of the second tank body 14 is slid over the free end of the connection pipe 15.

A disc-shaped anchor head 28 is finally screwed onto the free end of the second tie rod 18 in order to fasten the second tank body 14 tightly to the frame part 19 and to thus clamp it thereto.

Once both tank bodies 13, 14 are mounted, a respective stopper 25, 26 rests on each of the tank bodies 13, 14. As a result, the connection pipe 15 is axially secured in two directions and it is unable to be displaced and released from its position between the two tank bodies 13, 14 after mounting.

The lateral cladding 11' is then screwed onto the first tie rod 17 via a second, inner thread inside the tie rod. On the opposite side, the associated lateral cladding 11 is fastened in likewise manner to the first tie rod 17 of the first tank body 13.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicant's invention.

What is claimed is:

1. A self-propelled road construction machine, comprising:

a service water tank including two tank bodies which are connected in parallel via a balancing line, wherein the balancing line and the tank bodies are connected via a plug connection, in which the balancing line consists of a flexurally rigid connection pipe and the tank bodies respectively comprise sealed insertion openings for the pipe.

2. The road construction machine according to claim 1, wherein the tank bodies are arranged on both sides of a longitudinal central plane (M) of the road construction machine.

3. The road construction machine according to claim 1, wherein the tank bodies substantially have the same size and the same volume.

4. The road construction machine according to claim 1, wherein the connection pipe is guided in a self-supporting manner between the insertion openings.

5. The road construction machine according to claim 1, wherein the connection pipe comprises at least one axially acting first stopper for limiting the insertion depth.

6. The road construction machine according to claim 4, wherein two stoppers are provided in opposite end regions of the connection pipe.

7. The self-propelled road construction machine according to claim 1, wherein the tank bodies are respectively fastened to a support frame by a respective tie rod.

8. The road construction machine according to claim 7, wherein lateral claddings are attached to the free ends of the respective tie rods.

9. A production method for a road roller according to claim 1, comprising the following method steps:

inserting the connection pipe into the first tank body up to a first stopper;

fastening the first tank body to a support frame;

attaching the second tank body to the connection pipe; and fastening the second tank body to the support frame.

10. The method according to claim 8, wherein a lateral cladding is attached to the first and second tank bodies.

11. The road construction machine according to claim 1, wherein the road construction machine comprises a road roller.

* * * * *